US006412995B2

(12) United States Patent
Togashi et al.

(10) Patent No.: US 6,412,995 B2
(45) Date of Patent: Jul. 2, 2002

(54) PRINTING APPARATUS AND PLATEN WITH A PLURALITY OF IMPACT SURFACES

(75) Inventors: Shigemi Togashi; Yoichi Goto; Akihiro Moriyama, all of Fukushima (JP)

(73) Assignees: Oki Data Corporation, Tokyo; Oki Data Systems, Co., Ltd., Fukushima-ken, both of (JP)

( * ) Notice: Subject to any disclaimer, the term of this patent is extended or adjusted under 35 U.S.C. 154(b) by 0 days.

(21) Appl. No.: 09/771,298

(22) Filed: Jan. 25, 2001

(30) Foreign Application Priority Data

Jan. 28, 2000 (JP) ..... 2000-020066

(51) Int. Cl.[7] ..... B41J 11/08; B41J 11/14; B41J 11/48; B41J 11/50

(52) U.S. Cl. ..... 400/649; 400/656; 400/658; 400/588; 400/605; 400/584; 400/585; 347/220

(58) Field of Search ..... 400/648, 656, 400/657, 658, 659, 660, 660.3, 661, 661.1, 662, 588, 592, 605, 607, 608.2, 584, 585, 586, 655, 649, 82; 347/220

(56) References Cited

U.S. PATENT DOCUMENTS 1,309,332 A * 7/1919 Fenton ..... 400/82
3,854,563 A * 12/1974 Cowardin et al. ..... 400/112
4,560,296 A * 12/1985 Hanyu ..... 400/649
6,261,008 B1 * 7/2001 Omura ..... 400/58

FOREIGN PATENT DOCUMENTS

JP 05124274 A * 5/1993 ..... B41J/11/20
JP 06238965 A * 8/1994 ..... B41J/11/14
JP 09286148 A * 11/1997 ..... B41J/11/20

* cited by examiner

*Primary Examiner*—Daniel J. Colilla
(74) *Attorney, Agent, or Firm*—Akin, Gump, Strauss, Hauer & Feld, L.L.P.

(57) ABSTRACT

A platen has an impact surface positioned to oppose a printhead so that a part of a printhead strikes paper loaded on the impact surface. The platen includes a first impact surface having a curved surface, a second impact surface having a curved surface, and an opening formed between the first and second impact surfaces. The platen is rotatable about an axis such that the first and second impact surfaces are selectively positioned to oppose the printhead. Paper advances into the platen and passes through the opening from an inside of the platen to outside of the platen so that the paper extends to cover the first impact surface, and another paper advances to the second impact surface. The impact surfaces may have different curvatures with respect to the axis. A projection may be formed on the impact surface and extends transversely of the paper advancement. The projection is substantially configured to the flection of the paper.

17 Claims, 23 Drawing Sheets

PRINTING APPARATUS AND PLATEN WITH A PLURALITY OF IMPACT SURFACES

BACKGROUND OF THE INVENTION

1. Field of the Invention

The present invention relates to a printing apparatus in which when printing is performed, a printhead is pressed against a platen with a print medium sandwiched between the platen and print medium.

2. Description of the Related Art

A wire dot printer has been widely used and is used in recent Point of Sales system (POS system) to print on a multi-part journal paper and single sheets. In order to print on two different types of print paper, the POS system has two paths for transporting two types of print paper.

FIG. 27 illustrates a POS printer that prints on two different types of print paper.

FIG. 28 illustrates the POS printer that prints on a multi-part journal paper 7.

Referring to FIG. 27, a platen 2 is disposed to oppose a printhead 1. Disposed behind the platen 2 are a roll of journal paper 3 and a roll of receipt paper 4 that are ready to advance to a printing area. These two types of print paper are transported to the printhead 1 for printing. The POS printer also prints on another single sheet 5, which is transported to the printing area from under the printhead 1 for printing.

For POS printers, the single sheets 5 take the form of slip paper or check paper. When printing is performed on the single sheet 5, the printing is carried out with the single sheet 5 in direct contact with the journal paper 3 or receipt paper 4 if the journal paper 3 or the receipt paper 4 has been loaded on the platen 2. Moreover, as shown in FIG. 28, a similar case would occur if the multi-part journal paper 7 has been loaded on the platen 2.

FIG. 29 illustrates a problem with the conventional platen 2.

With the aforementioned conventional printer, when printing is performed on a single sheet 5 with the journal paper 3 or receipt paper 4 loaded at the printing area, the printhead 1 is moved relative to the single sheet 5 in a direction shown by arrow C. There is a gap 6 between the journal paper 3 and receipt paper 4 as shown in FIG. 29. Thus, the pins of the printhead 1 are apt to scratch the single sheet 5 at the gap 6. An additional problem is that printing results may not be sufficient in density at an area where the printhead 1 faces the gap 6.

FIG. 30 illustrates another problem with the conventional platen.

When printing is performed on the single sheet 5 with multi-part journal paper 7 loaded at the printing area, printing is carried out with the single sheet placed over the multi-part journal paper 7 as shown in FIG. 30. This way of printing wastes the multi-part journal paper 7, increasing the running cost of the multi-part journal paper 7.

SUMMARY OF THE INVENTION

The present invention was made in view of the aforementioned drawbacks of the conventional apparatus.

A platen having an impact surface positioned to oppose a printhead so that a part of a printhead strikes a print medium loaded on the impact surface. The platen comprises a first impact surface having a curved surface, a second impact surface having a curved surface, and an opening formed between the first and second impact surfaces. A print medium advances into the platen and passes through the opening from an inside of the platen to outside of the platen so that the print medium extends to cover one of the first and second impact surfaces. The platen is movable such that the first and second impact surfaces are selectively positioned to oppose the printhead.

The platen is rotatable about an axis and the first impact surface has a first curvature with respect to the axis and the second impact surface has a second curvature with respect to the axis.

A printing apparatus has an impact surface positioned to oppose a printhead so that the pins of a printhead strike a print medium against the impact surface. The apparatus comprises a plurality of impact surfaces used for printing different types of print medium supplied through different paths. Each of the plurality of impact surfaces is used for a corresponding type of print medium. A drive means causes the plurality of impact surfaces to selectively oppose the printhead so that print data is printed on one of the different types of print medium located between a corresponding one of the plurality of impact surfaces and the printhead.

The printing apparatus may further have an opening through which one of the different types of print medium passes, the opening being formed in a platen between adjacent ones of the plurality of impact surfaces.

The printing apparatus may be constructed such that the plurality of impact surfaces have curved surfaces with different curvatures.

The printing apparatus may be constructed such that the plurality of impact surfaces are made of a material different from other part of the platen.

The printing apparatus may further include means that holds the platen in position when one of the plurality of impact surfaces opposes the printhead.

The printing apparatus may have a projection formed on one of the plurality of impact surfaces. The projection extends in a direction substantially perpendicular to a direction in which the one of the different types of print medium advances. The projection is substantially configured to the flection of the one of the different types of print medium advances.

One of the plurality of impact surfaces of the printing apparatus is driven to selectively rotate about an axis to a first position and a second position. The first position is such that the at least one of the plurality of impact surfaces directly opposes the printhead. The second position is such that the at least one of the plurality of impact surfaces does not oppose the printhead. The plurality of impact surfaces are aligned with the printhead such that when the at least one of the plurality of impact surfaces rotates from the first position to the second position, the drive means causes an impact surface adjacent to the at least one of the plurality of impact surfaces to move closer to the printhead for printing.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings.

First Embodiment

{Construction}

Figure 1:
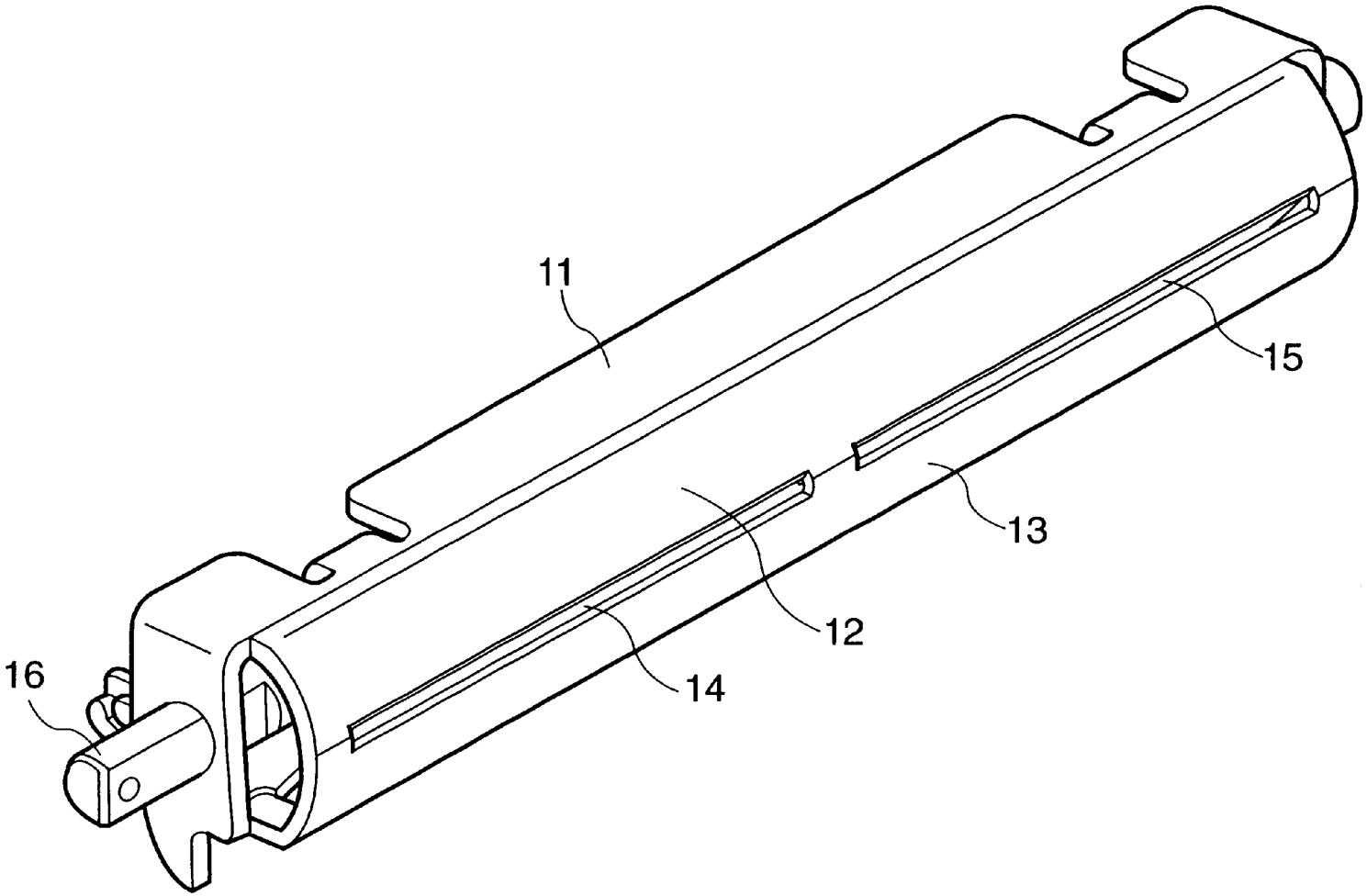
FIG. 1 is a perspective view of a platen according to a first embodiment.

FIG. 1 is a perspective view of a platen according to a first embodiment.

Figure 2:
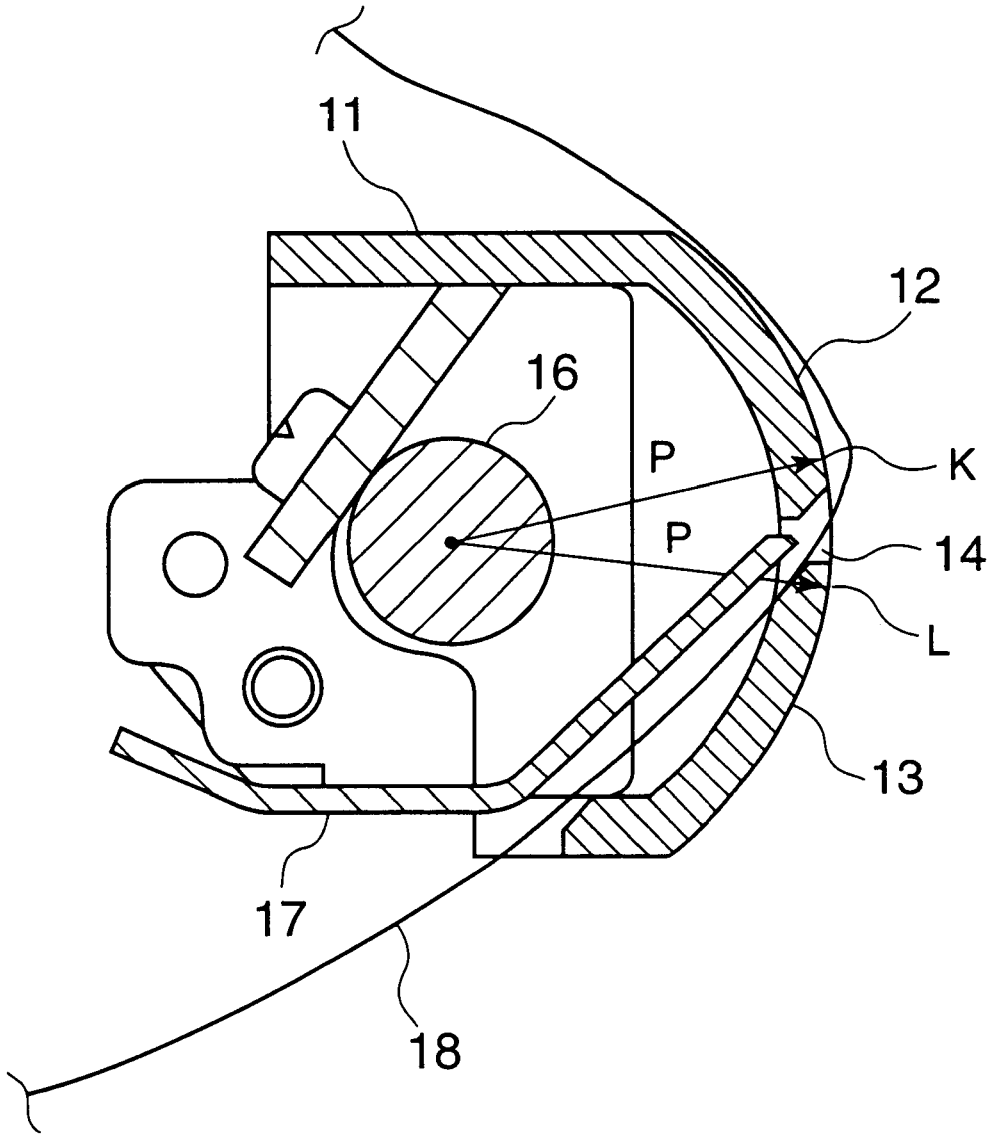
FIG. 2 is a cross-sectional view of the platen according to the first embodiment.

FIG. 2 is a cross-sectional view of the platen according to the first embodiment.

Referring to FIGS. 1 and 2, a platen 11 is formed by machining a solid material, e.g., steel, and has a curved impact surfaces 12 and 13. The impact surfaces 12 and 13 have flat, wide enough areas for the printhead 40 (FIG. 8) to print on the print paper. Slits 14 and 15 divide the impact surfaces 12 and 13 into upper parts and lower parts, respectively. The slit 14 is a longitudinal hole through which the multi part journal roll or 1P receipt passes. The slit 15 is a longitudinal hole thorough which only the 1P journal roll passes. The platen 11 has a shaft 16 about which the platen 11 is rotatable.

The platen 11 has a paper guide 17 that guides the paper passing through the slits 14 and 15. The curvatures of the curved surfaces of the impact surfaces 12 and 13 are equal to or larger than a curvature P that passes through two points K and L immediately above and below the slits 14 and 15.

Figure 3:
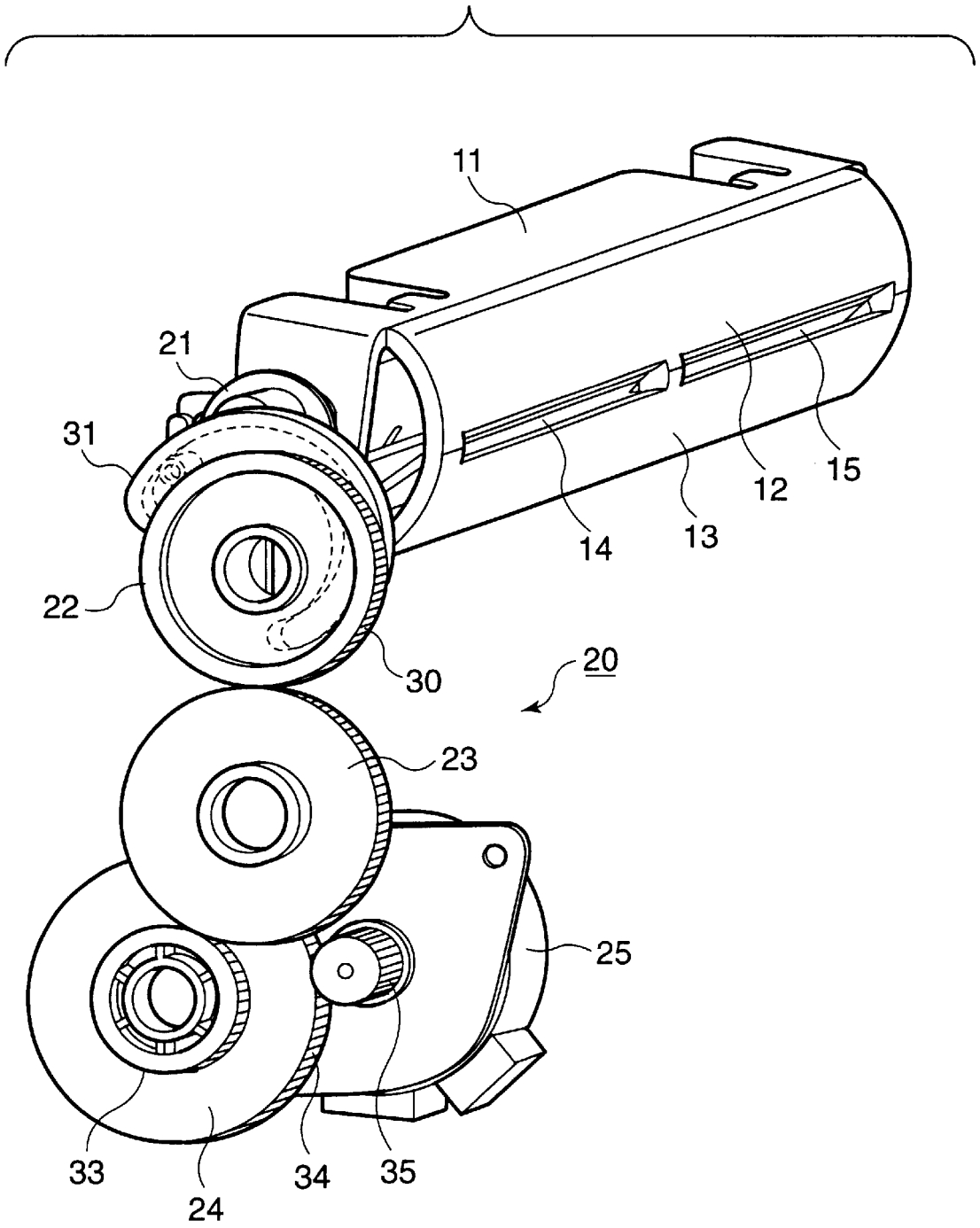
FIG. 3 is a perspective view of a platen drive unit of the first embodiment.

FIG. 3 is a perspective view of a platen drive unit of the first embodiment.

Figure 4:
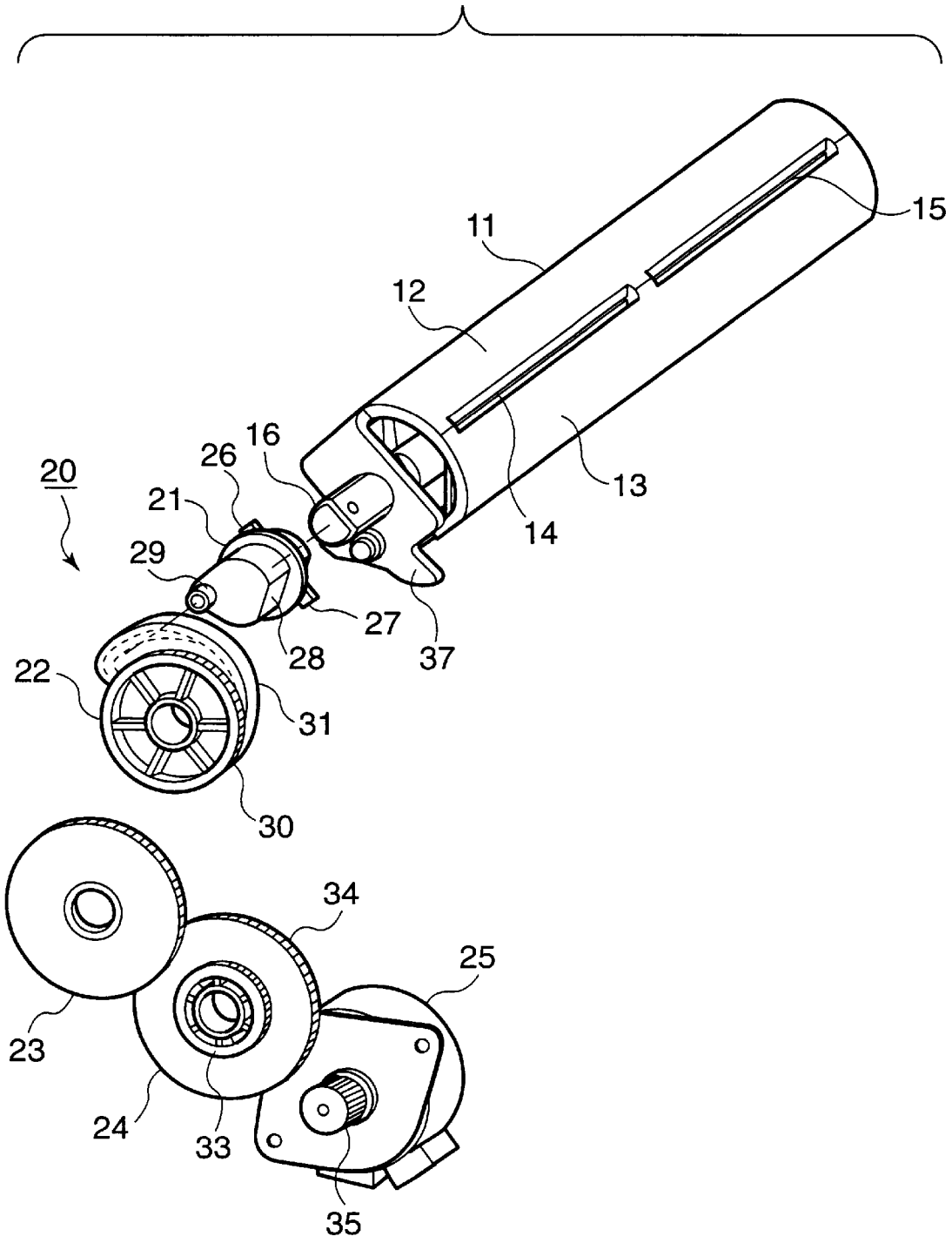
FIG. 4 is an exploded perspective view of the platen drive unit of the first embodiment.

FIG. 4 is an exploded perspective view of the platen drive unit of the first embodiment.

Referring to FIGS. 3 and 4, a platen drive unit 20 includes a boss 21, a cam lock 22, an idle gear 23, a reduction gear 24, and a drive motor 25. The boss 21 has two projections 26 and 27 and a rotary member 28. The projections 26 and 27 are fixedly supported by a frame, not shown, of a printer. The rotary member 28 is fixed mounted to an end of a platen shaft 16 so as to rotate together with the platen shaft 16. The rotary member 28 has a projection 29 formed at its one end to project therefrom. The projection 29 is off the rotational axis of the rotary portion 28.

Figure 5:
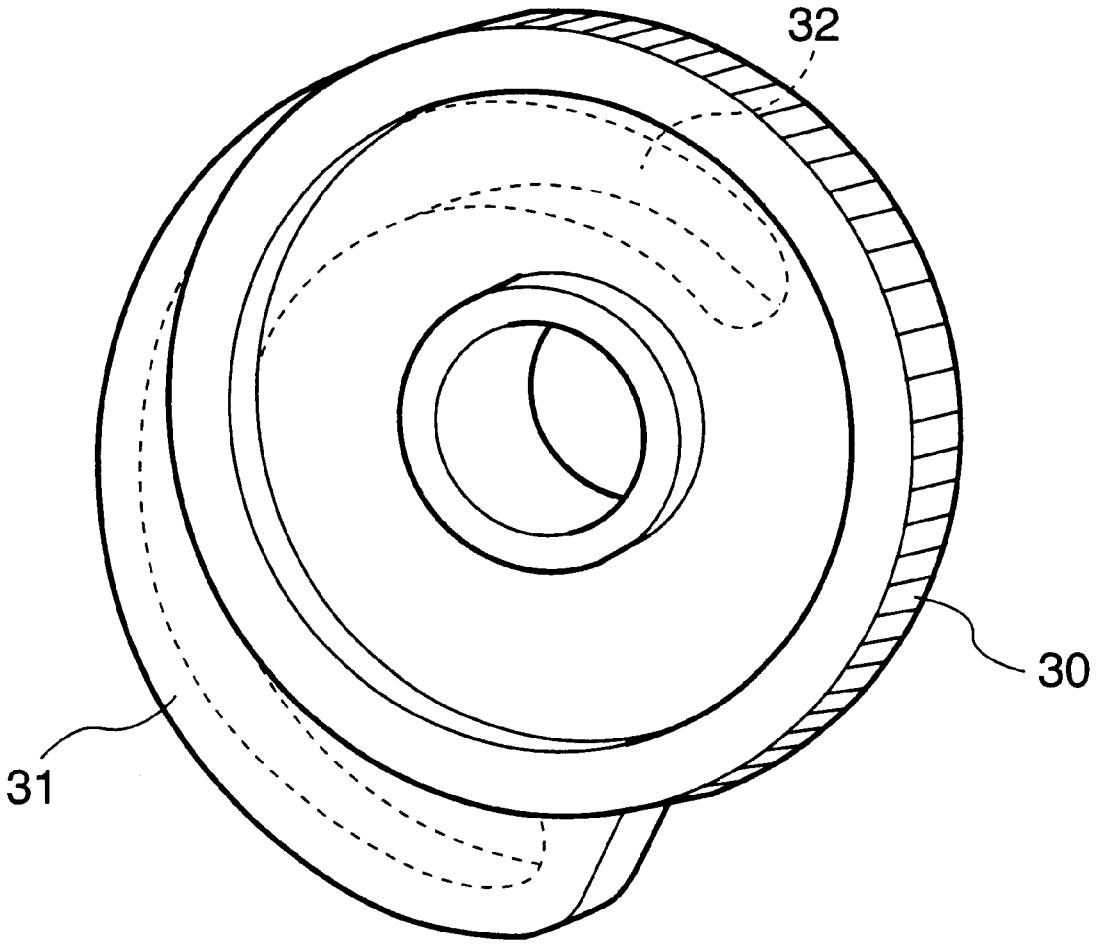
FIGS. 5 and 6 are perspective views of a cam lock.
Figure 6:
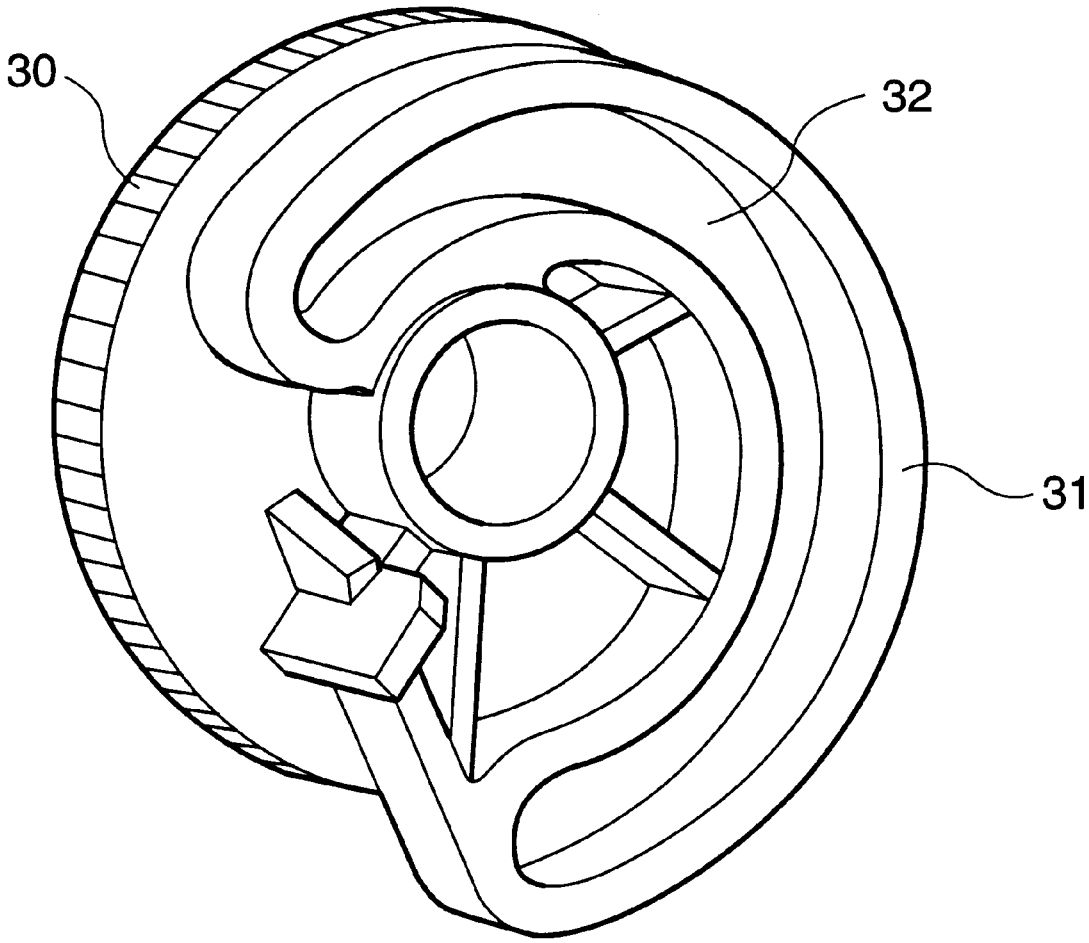

FIGS. 5 and 6 are perspective views of the cam lock.

Figure 7:
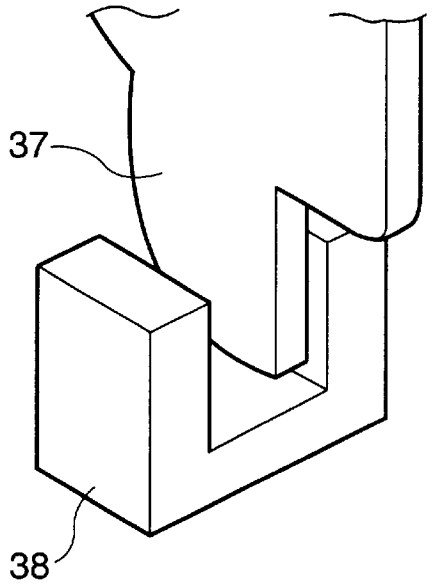
FIG. 7 illustrates a photo interrupter.

FIG. 7 illustrates a photo interrupter.

The cam lock 22 includes a gear 30 and a cam 31. As shown in FIGS. 5 and 6, the cam 31 is formed with a cam groove 32 that describes a cam curve. The cam groove 32 receives the projection 29 of the boss 21 so that when the cam lock 22 rotates, the projection 29 slides along the cam groove 32. The gear 30 is in mesh with the idle gear 23. The idle gear 23 is in mesh with a small gear 33 of the reduction gear 24. A large gear 34 of the reduction gear 24 is in mesh with a motor gear 35. The cam lock 22, idle gear 23, reduction gear 24 are rotatably supported on the frame of the platen and the drive motor 25 is fixedly mounted to the frame.

As shown in FIG. 4, the platen 11 has a projection 37 formed on an end thereof to radially project. When the projection 37 interrupts the optical path of the photo interrupter 38 as shown in FIG. 7, the photo interrupter 38 detects the rotational position of the platen 11.

Figure 8:
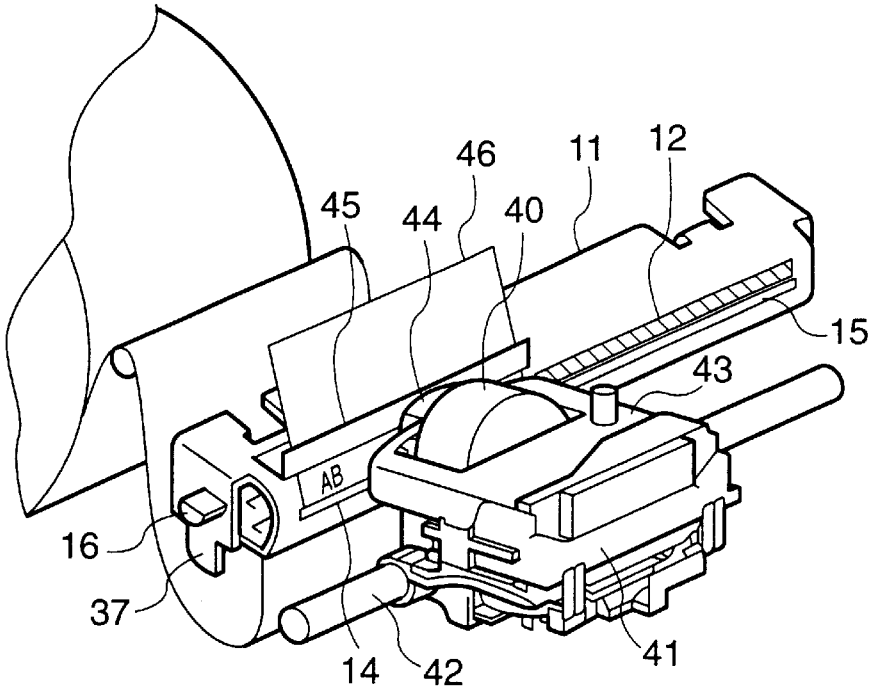
FIG. 8 is a perspective view of the printhead and platen according to the invention.

FIG. 8 is a perspective view of the printhead and platen according to the invention.

Figure 9:
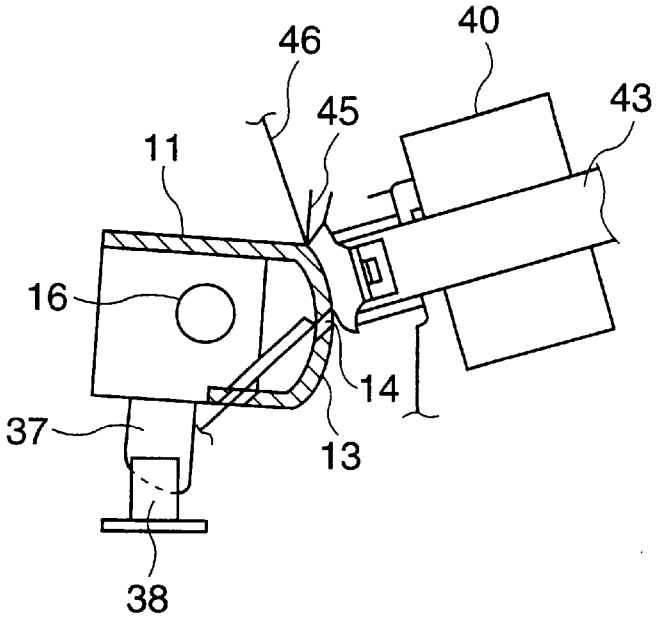
FIG. 9 is a side view illustrating the printhead and platen.

FIG. 9 is a side view of the printhead and platen.

Referring to FIGS. 8 and 9, a printhead 40 is disposed to oppose the platen 11. The printhead 40 is carried on a self-powered carriage 41 that is guided along a carriage guide 42 to move back and forth in a traverse direction. A ribbon cassette 43 is mounted to the carriage 41 such that the ink ribbon extends to surround the front of the printhead 40. A guide plate 45 is mounted on the top of the platen 11 and guides the print paper.

Multi-part journal paper 46 in a roll is loaded to the platen. The multi-part journal paper 46 enters a lower portion of the platen 11 from behind and passes through the slit 14 to the outside of the platen 11. Then, the multi-part journal paper 46 passes through a slit formed in the guide plate 45. The multi-part journal 46 is in intimate contact with the curved surface 12.

Figure 10:
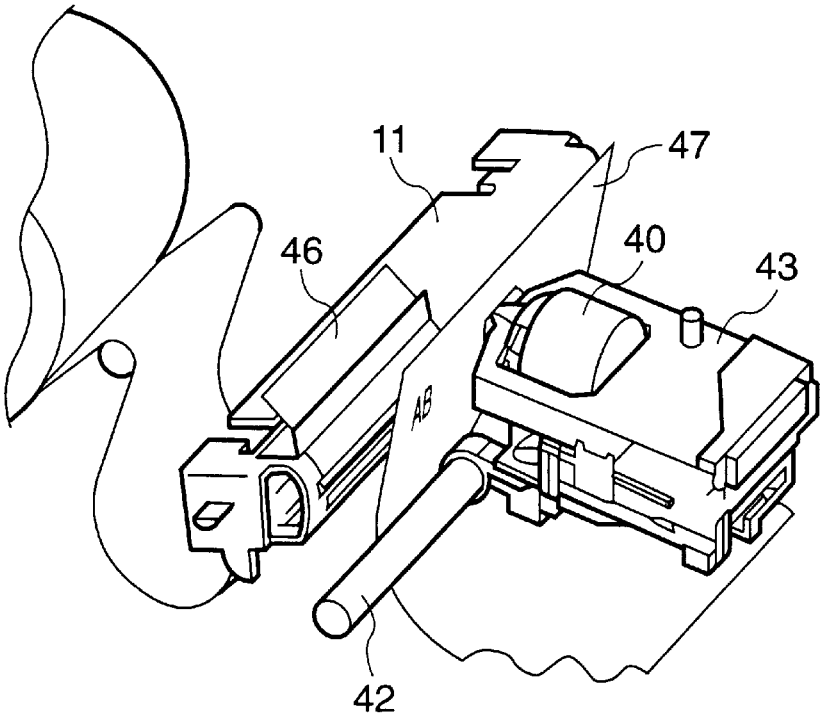
FIG. 10 is a perspective view illustrating the positional relationship between the printhead and platen.

FIG. 10 is a perspective view illustrating the positional relationship between the printhead and platen.

Figure 11:
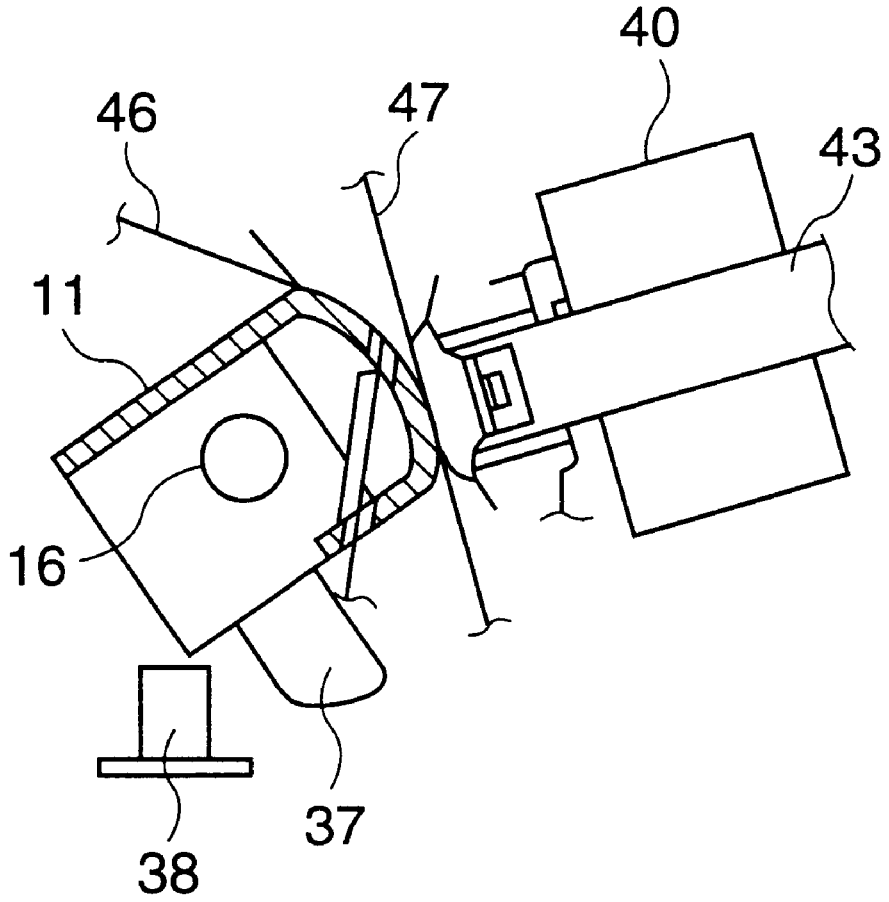
FIG. 11 is a side view illustrates the positional relationship between the printhead and platen.

FIG. 11 is a side view illustrates the positional relationship between the printhead and platen.

Referring to FIGS. 10 and 11, the printhead 40 opposes another curved surface 13 of the platen 11. A single sheet 47 is loaded between the printhead 40 and the platen 11 together with the multi-part paper 47. It is to be noted that the printhead 40 opposes the curved surface 13 of the platen 11 and the single sheet 47 is not positioned on the multi-part journal paper 46. With the platen positioned as shown in FIGS. 10 and 11, the projection 37 opens the optical path of the photo interrupter 38.

Figure 12:
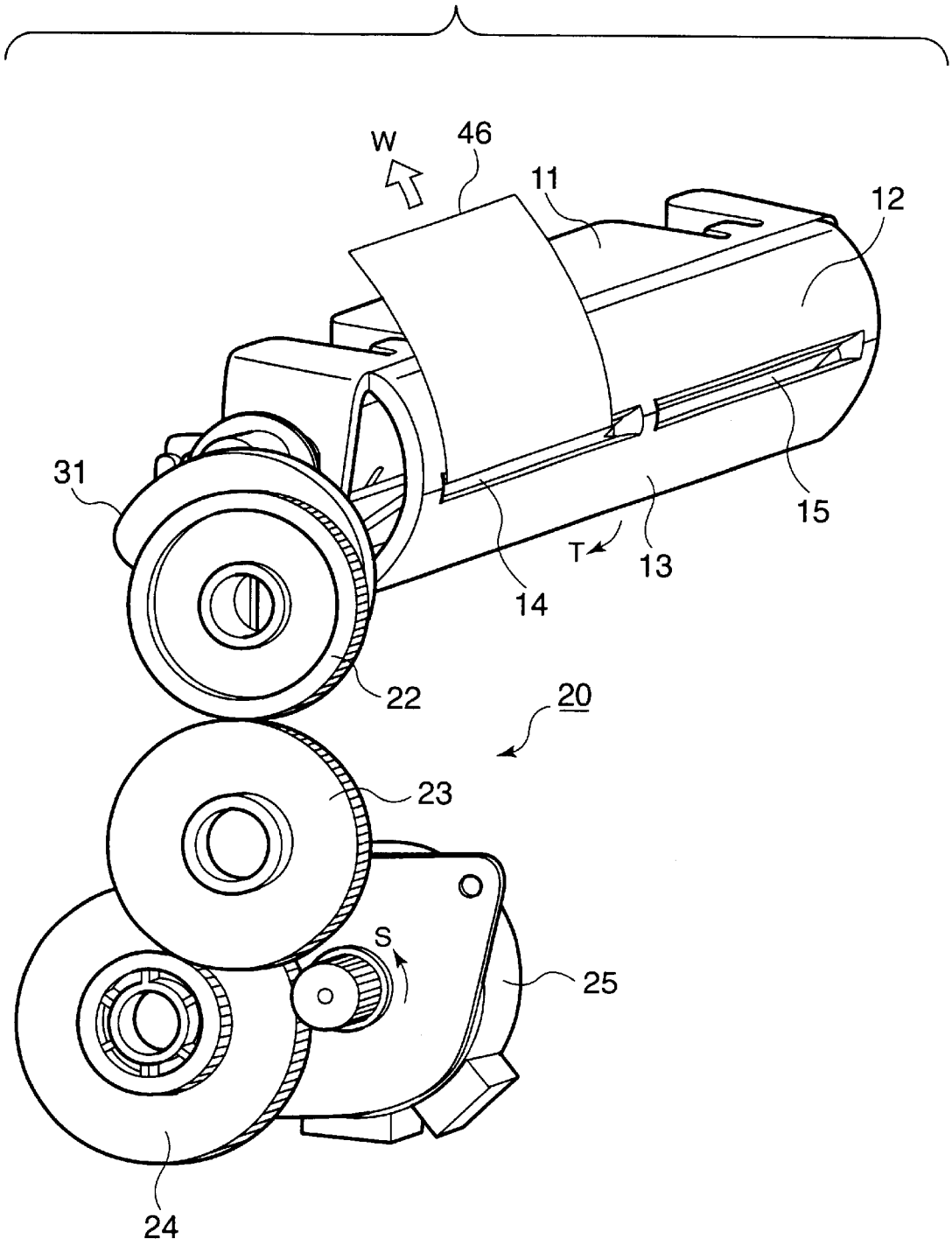
FIGS. 12 and 13 illustrate the operation of a platen driving mechanism.
Figure 13:
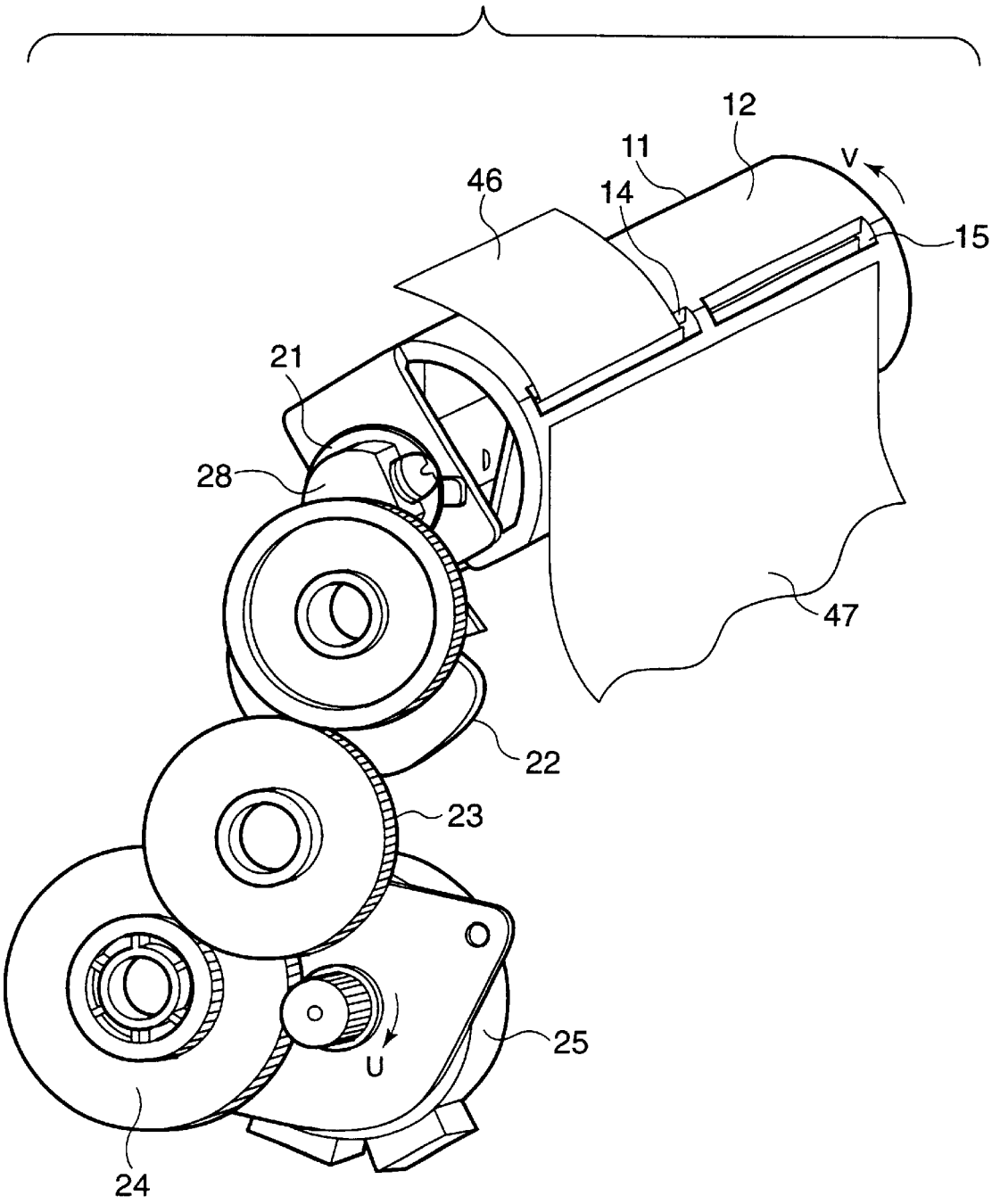

FIGS. 12 and 13 illustrate the operation of a platen driving mechanism.

When the cam lock 22 rotates clockwise in FIG. 12, the projection 29 and the rotary portion 28 of the boss 21 rotate in the clockwise direction. Thus, the platen 11 rotates in a direction shown by arrow T so that the printhead 40 opposes the curved surface of the impact surface 12. As the platen 11 rotates, the projection 37 interrupts the sensor 38 which in turn causes the drive motor 25 to stop. As a result, the impact surface 12 of the platen 11 opposes the printhead 40 as shown in FIGS. 8 and 9. Then, upon a command from a host apparatus, the printhead prints data on the multi-part journal paper 46.

{Printing Single Sheets}

A printing operation for printing on the single sheet will be described. In this case, it is assumed that the multi-part journal paper 46 has been loaded to the platen 11 as shown in FIG. 13. The single sheet 47 is loaded between the platen 11 and the printhead 40. Under the control of a host apparatus, not shown, the drive motor 25 rotates in a direction shown by arrow U as shown in FIG. 13, so that the reduction gear 24, idle gear 23, cam lock 22 rotate and the projection 29 slides in the guide groove 32 formed in the cam 31 of the cam lock 22.

When the cam lock 22 rotates counterclockwise in FIG. 13, the projection 29 and the rotary member 28 of the boss 21 rotate in the same direction as the cam lock 22. Thus, the platen 11 and the shaft 16 also rotate counterclockwise, i.e., in a direction shown by arrow V so that the printhead 40 opposes the curved surface of the impact surface 13. Due to the rotation of the platen 11, the projection 37 leaves the sensor 38, which in turn causes the drive motor 25 to stop after a predetermined time, so that the platen 11 takes up a position at which the printhead 40 properly opposes the impact surface 13 of the platen 11 as shown in FIGS. 10 and 11. The predetermined time is experimentally determined. Then, upon a command from a host apparatus, the printhead 40 prints the data on the single sheet 47. There is no print paper behind the single sheet 47 and therefore the printing operation is carried out with the single sheet 47 in direct contact with the platen 11.

{Mechanism for Holding the Platen in Position}

As described above, the position of the platen 11 differs depending on whether printing is performed on the multi-part journal paper or on the single sheet. A mechanism for holding the platen 11 in position will be described with respect to the both cases. Holding the platen 11 at predetermined positions is important for two reasons; the platen tends to rotate due to its own weight and the platen also tends to rotate when the user attempts to pull out the print paper from between the platen 11 and printhead 40. Thus, it is important to maintain the platen at the predetermined positions.

{When the Platen Rotates Due to its Weight}

Figure 14:
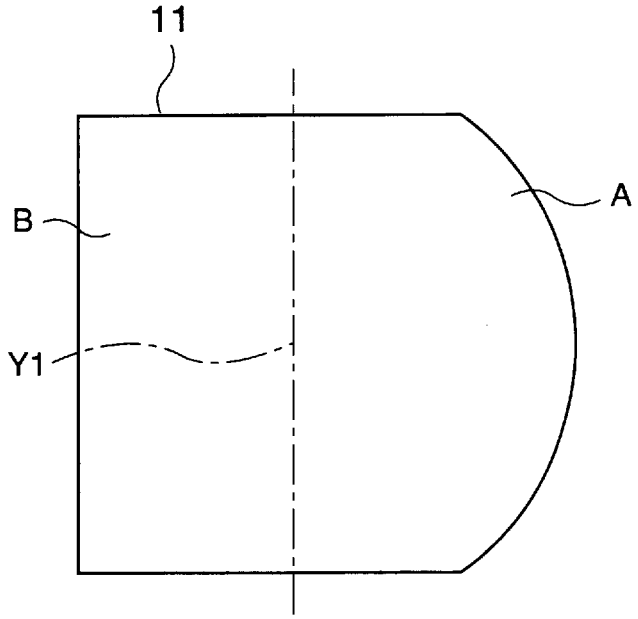
FIG. 14 schematically illustrates an outer contour of the platen 11.

FIG. 14 schematically illustrates an outside shape of the platen 11.

Referring to FIG. 14, the platen 11 has a right portion A and a left portion B with respect to a center line that passes through a rotational axis Y1. The portion A has a larger weight than the portion B. Thus, if the platen 11 is set for free rotation, the platen 11 will rotate clockwise.

Figure 15:
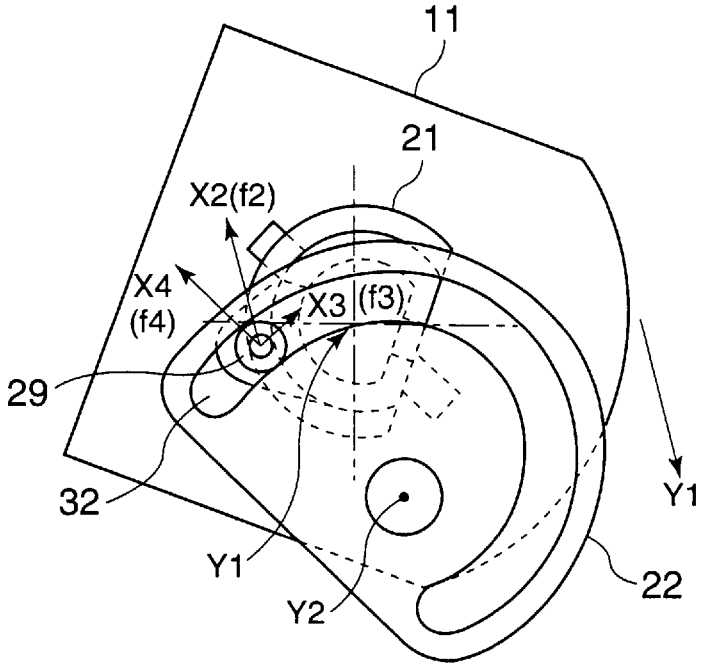
FIG. 15 illustrates the position of the platen when it tends to rotate due to its own weight.
Figure 16:
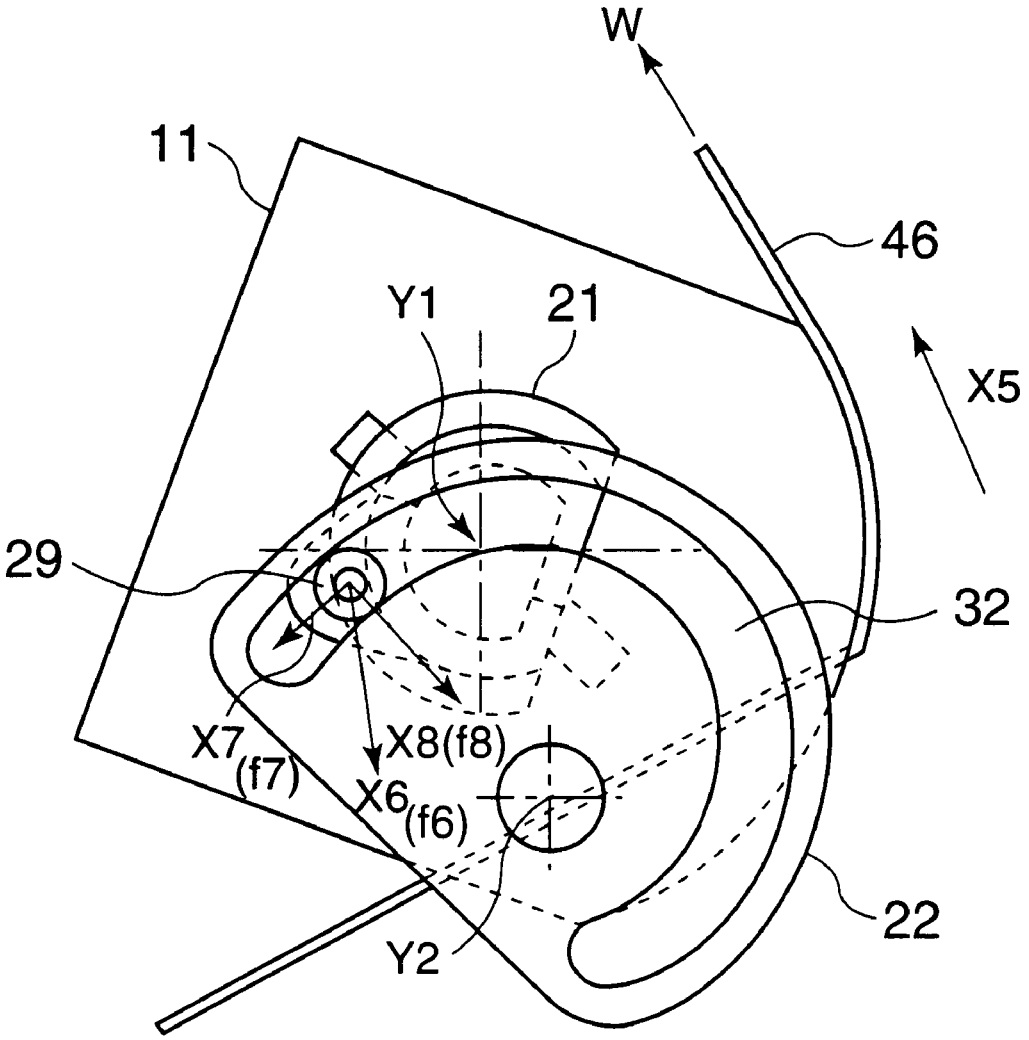
FIG. 16 illustrates the position of the platen when the user attempts to pull out the paper.

FIGS. 15 and 16 illustrate the mechanism for holding the platen in position when printing is performed on the multi-part journal paper.

FIG. 15 illustrates the position of the platen 11 when it tends to rotate due to its own weight.

FIG. 16 illustrates the position of the platen when the user attempts to pull out the paper.

The mechanism includes the boss 21 and the cam lock 22.

Referring to FIG. 15, the platen 11 will rotate about the rotational axis Y1 in a direction shown by arrow X1. When the platen 11 tends to rotate in the direction shown by arrow X1, the projection 29 of the boss 21 exerts a force f2 on the cam lock 22. The force f2 is resolved into a force f3 that causes the projection 29 to slide in the cam groove 32 in a direction shown by arrow X3 and a force f4 acting in a direction shown by arrow X4, i.e., perpendicular to the direction shown by arrow X3. The cam groove 32 is inclined at an angle such that the force f4 is greater than the force f3 at a position where the projection 29 engages the cam lock 22. The force f4 and the force f3 are related such that f4>f3. After the platen 11 is inclined to the position of FIG. 15, the motor 25 stops so that the platen remains at the position of FIG. 7.

Referring to FIG. 16, when the user pulls the multi-part journal paper 46 upward (in a direction shown by arrow W), the platen 11 receives a force in a direction shown by arrow X5. As a result, the projection 29 exerts a force f6 acting in a direction shown by arrow X6 on the cam groove 32. The force f6 is resolved into a force f7 that causes the projection 29 to slide along the cam groove 32 in a direction shown by arrow X7 and a force f8 acting in a direction X8, i.e., perpendicular to the direction shown by arrow X7. The cam groove 32 is inclined at an angle such that the force f8 is greater than the force f7 at a position where the projection 29 engages the cam lock 22. The force f7 and the force f8 are related such that f8>f7. After the platen 11 is inclined to the position of FIG. 16, the motor 25 stops so that the platen remains at the position of FIG. 16.

Figure 17:
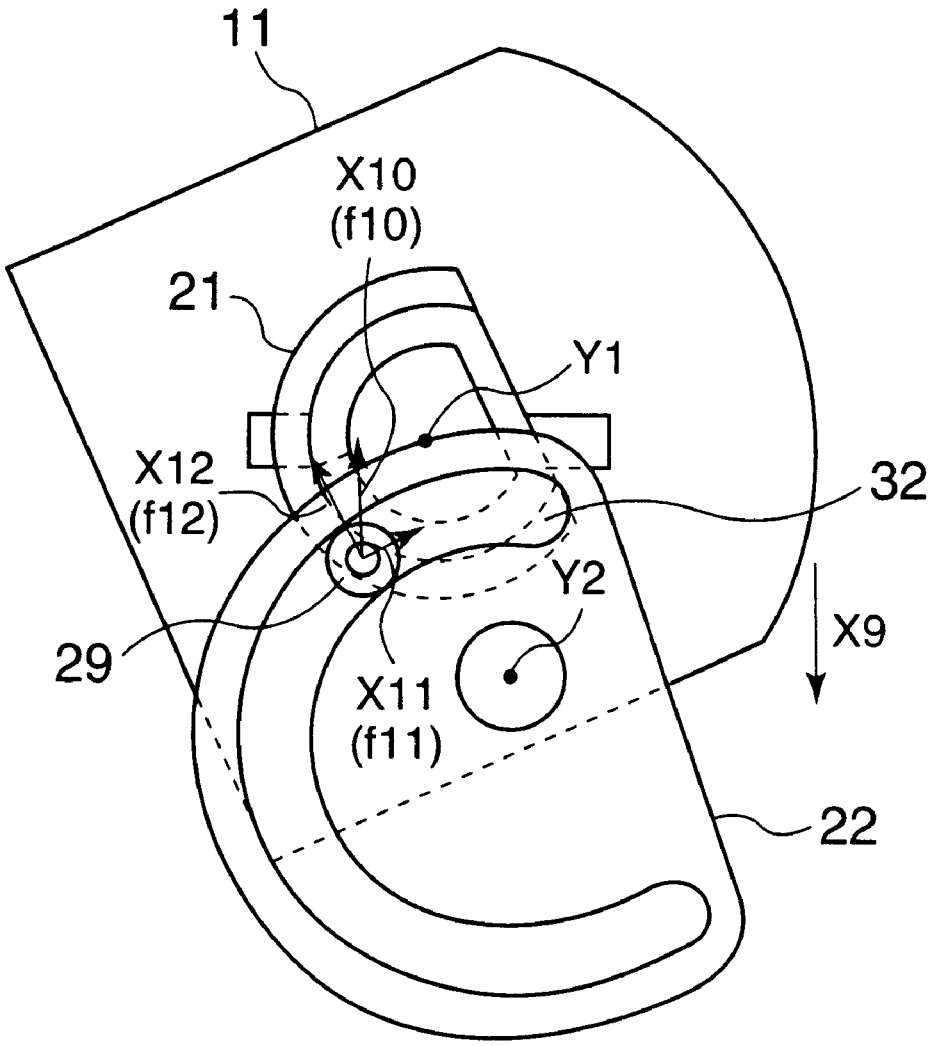
FIG. 17 illustrates the position of the platen when it tends to rotate due to its own weight.
Figure 18:
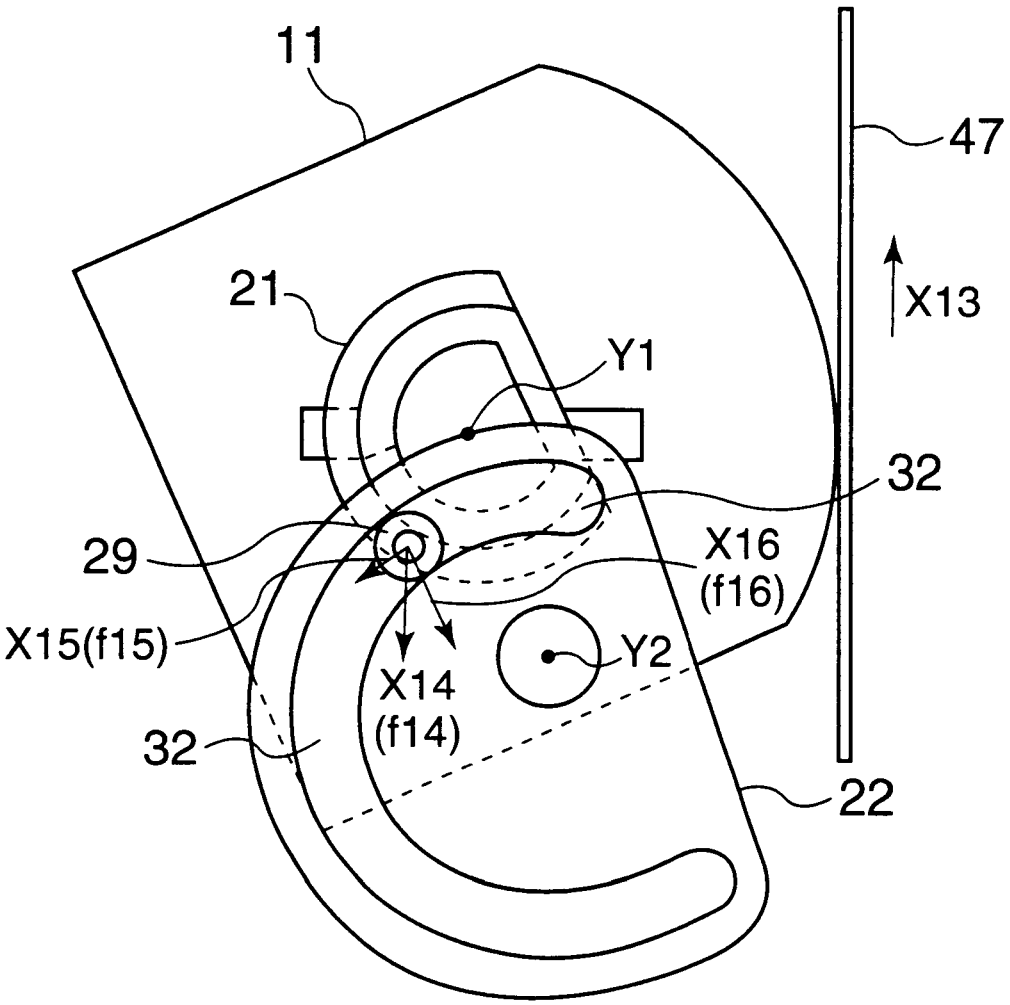
FIG. 18 illustrates the position of the platen when the user attempts to pull out the paper.

FIGS. 17 and 18 illustrate the mechanism for holding the platen in position when printing is performed on the single sheet.

FIG. 17 illustrates the position of the platen when it tends to rotate due to its own weight.

FIG. 18 illustrates the position of the platen when the user attempts to pull out the paper.

The mechanism includes the boss 21 and the cam lock 22.

Referring to FIG. 17, the platen 11 will rotate about the rotational axis Y1 in a direction shown by arrow X9. When the platen 11 tends to rotate in the direction shown by arrow X9, the projection 29 of the boss 21 exerts a force f10 on the cam lock 22. The force f10 is resolved into a force f11 that causes the projection 29 to slide in the cam groove 32 in a direction shown by arrow X11 and a force f12 acting in a direction shown by arrow X12, i.e., perpendicular to the direction shown by arrow X11. The cam groove 32 is inclined at an angle such that the force f12 is greater than the force f11 at a position where the projection 29 engages the cam lock 22. The force f12 and f11 are related such that f12>f11. The force f11 and the force f12 are related such that f12>f11. After the platen 11 is inclined to the position of FIG. 17, the motor 25 stops so that the platen 11 remains at the position of FIG. 17.

Referring to FIG. 18, when the user pulls the multi-part journal paper 46 upward (in a direction shown by arrow X13), the projection 29 exerts a force f14 on the cam groove 32 in a direction shown by arrow X14. The force f14 is resolved into a force f15 that causes the projection 29 to slide along the cam groove 32 in a direction shown by arrow X15 and a force f16 acting in a direction X16, i.e., perpendicular to the direction shown by arrow X15. The cam groove 32 is inclined at an angle such that the force f16 is greater than the force f15 at a position where the projection 29 engages the cam lock 22. The force f15 and f16 are related such that f16>f15. After the platen 11 is inclined to the position of FIG. 18, the motor 25 stops so that the platen remains at the position of FIG. 18.

As mentioned above, according to the first embodiment, when printing is performed on a single sheet without the single sheet being placed on the multi-part journal paper that has been loaded to the platen 11. Moreover, the first embodiment completely eliminates the chance of pins of the printhead scratching the single sheet paper.

Second Embodiment

Figure 19:
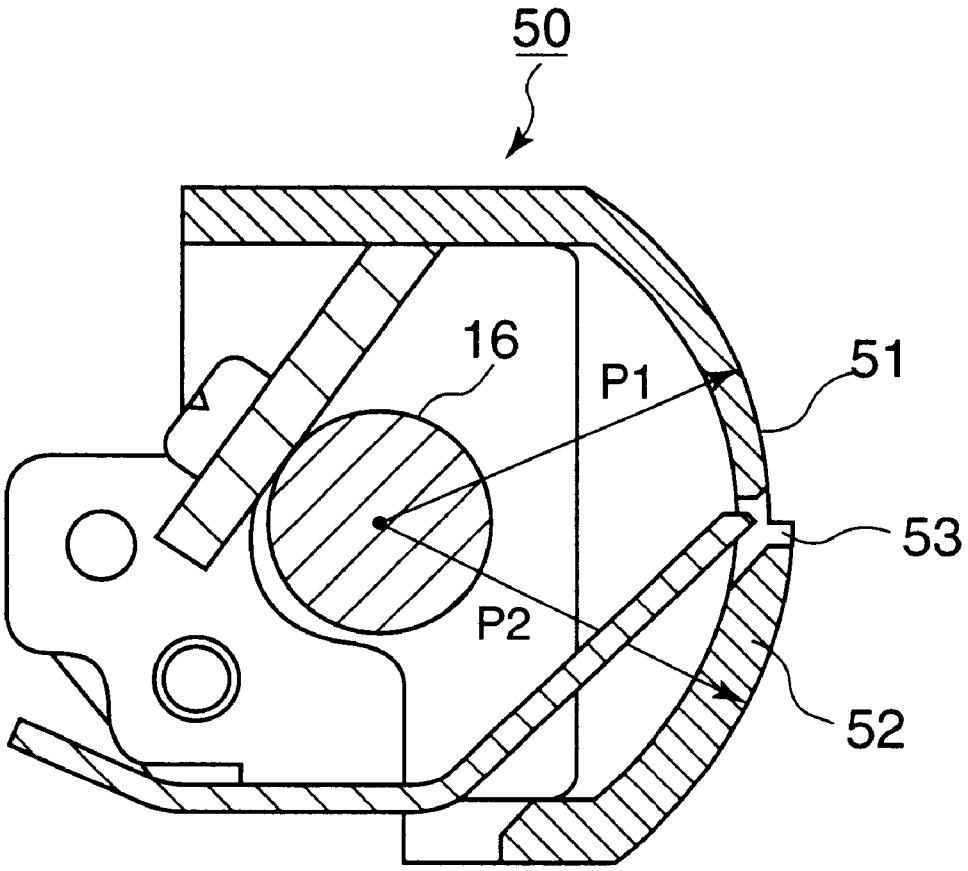
FIG. 19 is a cross-sectional view of a platen according to a second embodiment.

FIG. 19 is a cross-sectional view of a platen according to a second embodiment.

The second embodiment is characterized in that the multi-part journal paper is thicker than that in the first embodiment and the two impact surfaces have different curvatures.

Referring to FIG. 19, the platen 50 according to the second embodiment has two impact surfaces 51 and 52. Just as in the first embodiment, two slits 53 are provided. The slits 53 extend in a longitudinal direction of the platen 50, bounding the impact surfaces 51 and 52. The impact surface 51 has a curvature P1 and the impact surface 52 has a curvature P2 such that P1<P2. The multi-part journal paper is loaded to the platen 50 such that the multi-part journal paper is in contact with the curved surface 51 while the single sheet is loaded to the platen 50 such that the single sheet is in contact with the impact surface 52. The curvatures P1 and P2 are selected such that the difference P2−P1 is equal to the difference in thickness between the multi-part journal paper and the single sheet, specifically, P2−P1=0.06 mm. The rest of the construction of the second embodiment is the same as that of the first embodiment.

The curvature of upper impact surface 51 smaller than that of the lower impact surface 52 offers the following advantage. The ordinary multi-part journal paper of down to a thickness of 0.18 mm can be printed with a head gap (e.g., range 1 is for paper thickness 0.12 mm) used for printing a single sheet, eliminating the need for adjustment of the head gap.

The upper impact surface 51 may have different curvatures on its left half and left half. For example, the platen 50 may be configured such that the left half of the impact surface 51 has a small curvature and the right half has the same curvature as the lower impact surface 52. This configuration allows the multi-impact surface journal paper to be loaded on the left half and the receipt paper to be loaded on the right half.

Third Embodiment

Figure 20:
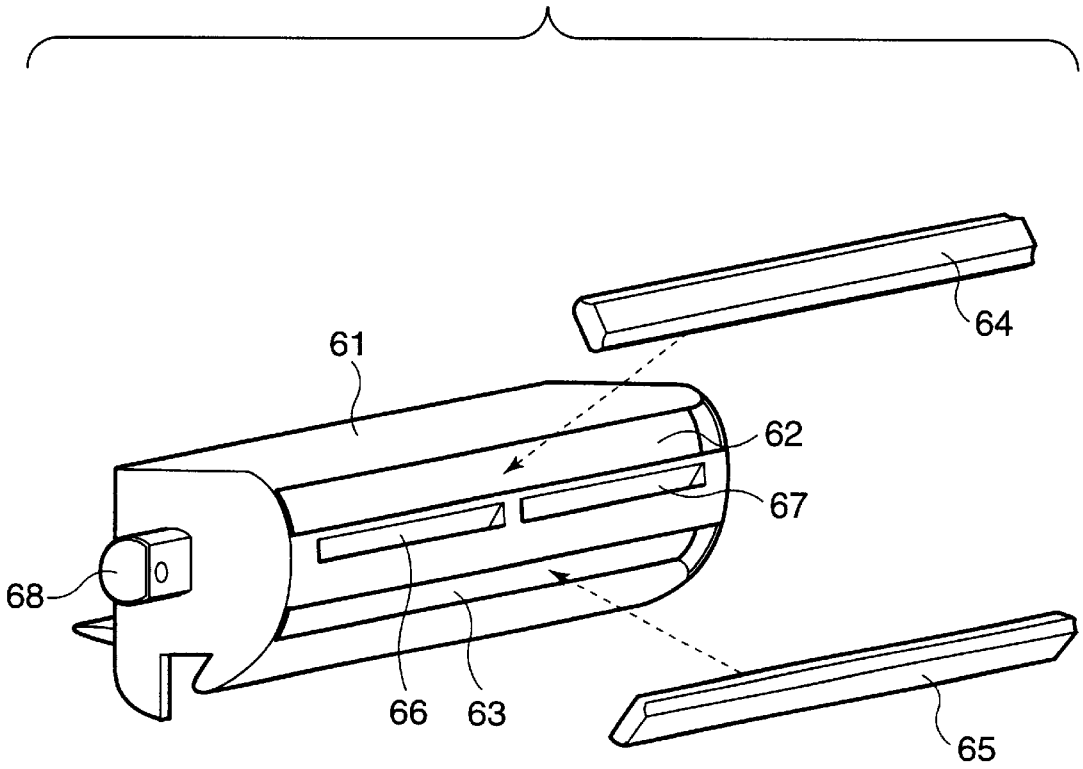
FIG. 20 is an exploded perspective view illustrating a platen according to a third embodiment.

FIG. 20 is an exploded perspective view of a platen according to a third embodiment.

Figure 21:
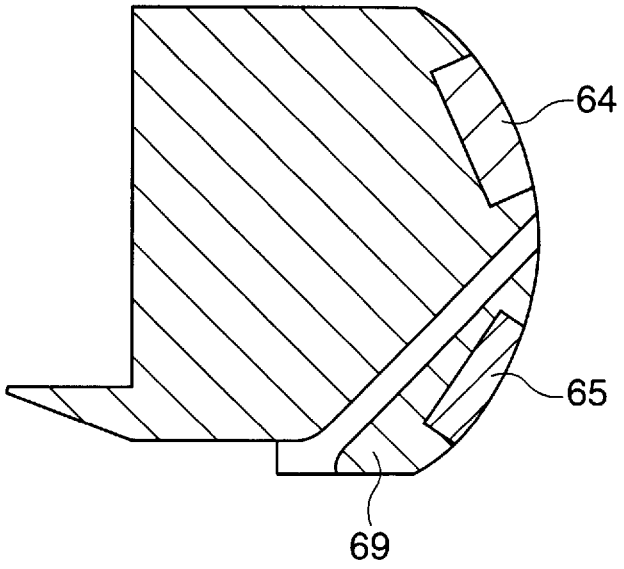
FIG. 21 is a cross-sectional view of the platen according to the third embodiment.

FIG. 21 is a cross-sectional view of the platen according to the third embodiment.

The third embodiment is characterized in that the impact surfaces of the platen are made of different materials from the main body of the platen.

Referring to FIGS. 20 and 21, a platen 61 has longitudinally extending grooves 62 and 63 formed therein. The grooves receive impact surfaces 64 and 65 therein. The impact surfaces 64 and 65 have surfaces of the same curvature as the main body of the platen 61 so that the impact surfaces cooperate with the main body of the platen 61 form a continuous curved surface after they have been assembled as shown in FIG. 21. The impact surfaces 64 and 65 are formed of a hard material, for example, steel, a different material from the platen 61.

The body of the platen 61 has slits 66 and 67 formed therein to longitudinally extend below the groove 62. The slits 66 and 67 are openings through which the receipt paper and journal paper in roll form attached to the platen 61 from behind. The platen 61 has a shaft 68 formed in one piece construction with the platen 61 or formed as a separate shaft that extends through the platen 61. As shown in FIG. 21, the platen 61 incorporates a transport path 69 along which the receipt paper or journal paper in roll form passes. The transport path 69 is formed in one piece construction with the platen 61. The rest of the construction is the same as the first embodiment.

The main body of the platen 61 can be molded so that the transport path that guides the print paper in roll form can be formed in one piece construction with the main body and the number of parts can be reduced. Thus, the total manufacturing cost of the platen can be reduced. The impact surfaces 64 and 65 made of a hard material prevent the printing results from being low density, thereby prolonging the life of the platen 61. The impact surface 64 may have a smaller curvature than the impact surface 65.

Fourth Embodiment

Figure 22:
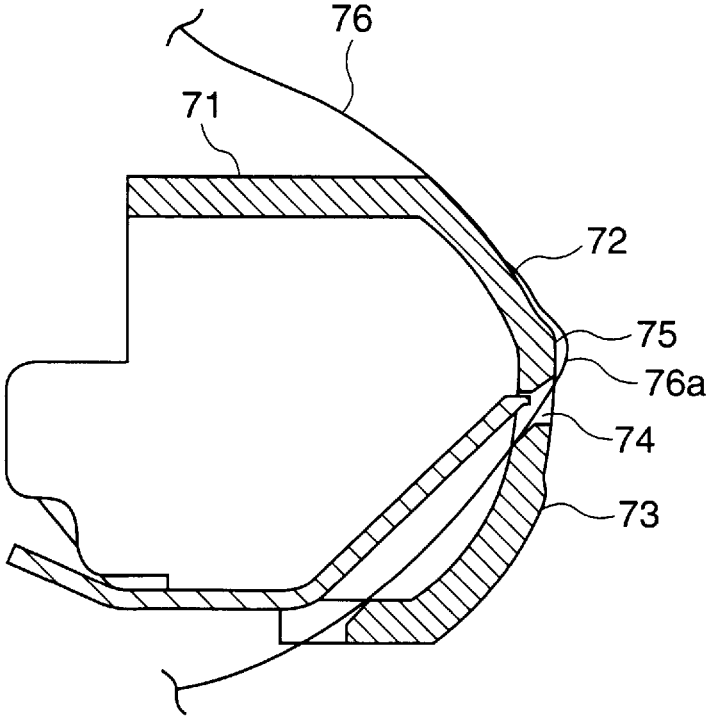
FIG. 22 is a cross-sectional view of a platen according to a fourth embodiment.

FIG. 22 is a cross-sectional view of a platen according to a fourth embodiment.

The fourth embodiment is characterized in that the impact surface of the platen against which the print paper in roll form is loaded has a projection that is configured to the bending of the print paper and laterally extends across the platen.

Referring to FIG. 22, the platen 71 has impact surfaces 72 and 73 and a slit 74 formed therein between the impact surfaces 72 and 73. The impact surface 72 has a longitudinal projection 75 near the slit 74. The receipt paper 76 in roll form is loaded against the curved surface 72. The projection 75 is configured to the flection of the print paper 76 so that the print paper 76 is substantially in intimate contact with the projection 75.

The fourth embodiment prevents the print paper from lifting up from the impact surface when the print paper in roll form is loaded on the platen. This in turn prevents the print paper from fluttering during printing, thereby reducing noise as well as improving print quality.

The projection configured to the bending of the print paper may also be provided to impact surfaces of the third embodiment.

Fifth Embodiment

Figure 23:
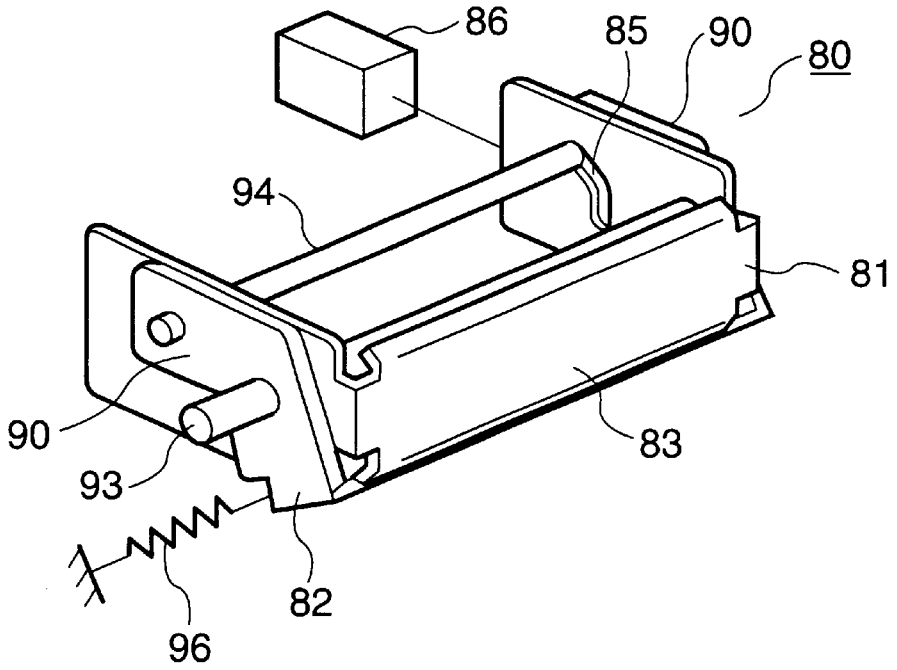
FIG. 23 is a perspective view of a platen according to a fifth embodiment.

FIG. 23 is a perspective view of a platen according to a fifth embodiment.

Figure 24:
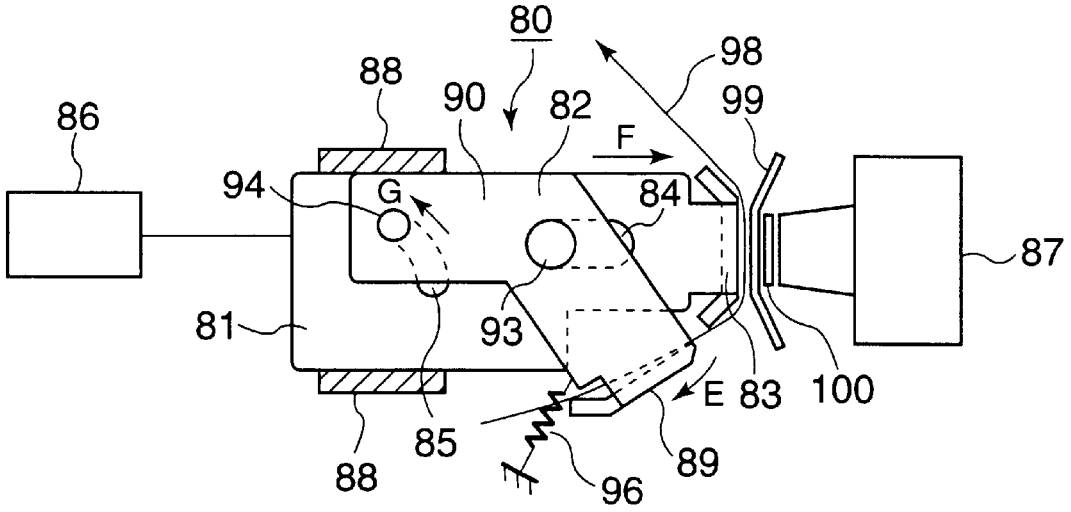
FIG. 24 is a side view of the platen and printhead according to the fifth embodiment.

FIG. 24 is a side view of the platen and printhead according to the fifth embodiment.

Figure 25:
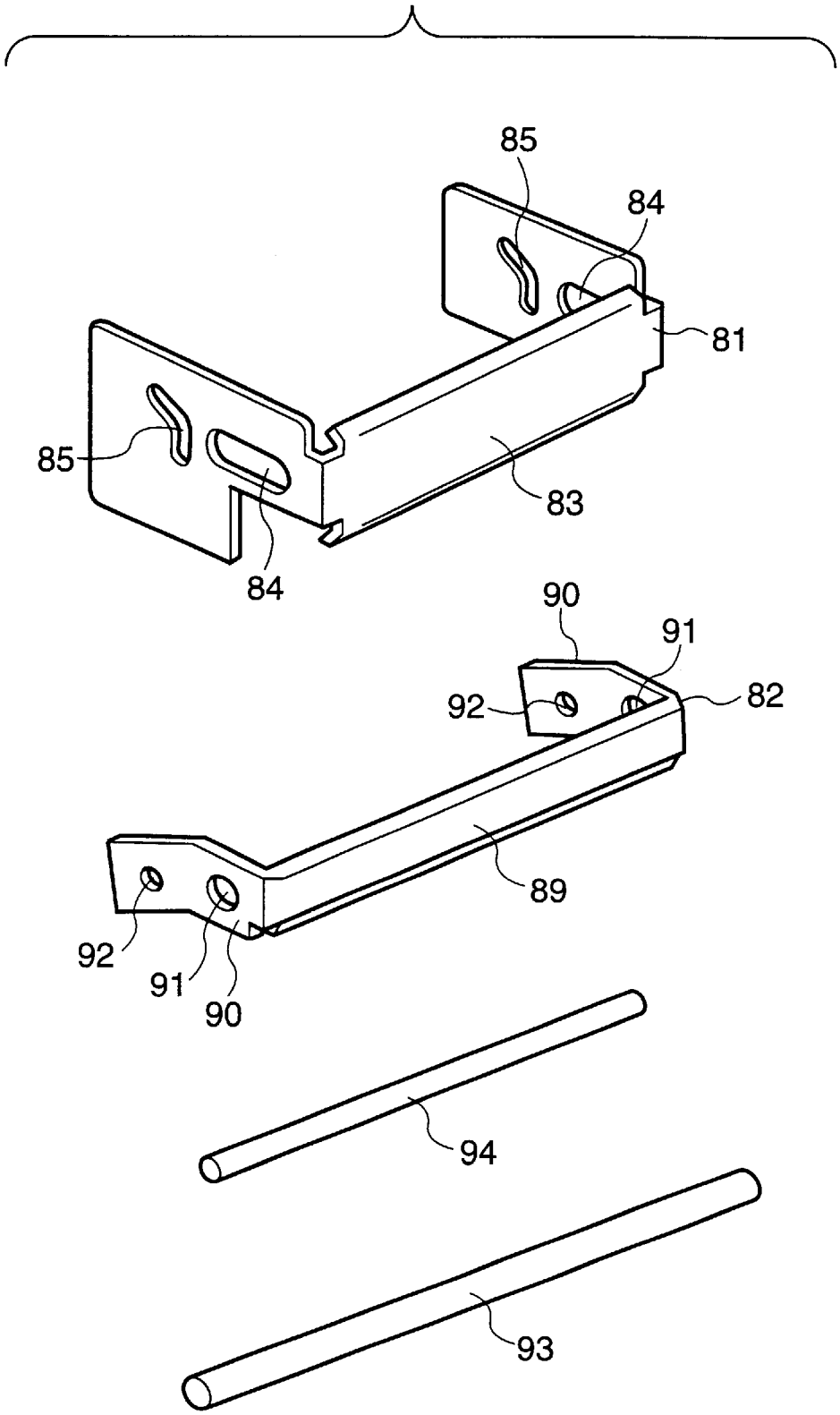
FIG. 25 is an exploded perspective view illustrating the platen according to the fifth embodiment.

FIG. 25 is an exploded perspective view illustrating the platen according to the fifth embodiment.

The fifth embodiment is characterized in that there are provided two platens that are selectively used depending on the type of print paper.

Referring to FIGS. 23, 24, and 25, a platen 80 includes a first platen 81 and a second platen 82. The first platen 81 is U-shaped and has an impact surface 83 formed in the middle portion of the U-shape and elongated holes 84 and guide holes 85 formed in the opposed side portions of the U-shape.

The first platen 81 is urged by a solenoid 86 (or motor) in a direction away from a printhead 87. As shown in FIG. 23, on the top and the underside of the first platen 81, there are provided slide guides 88 that guide the movement of the first platen 81.

The second platen 82 is also U-shaped and has an impact surface 89 in the middle portion of the U-shape and fitting holes 91 and 92 formed in the opposed side portions of the U-shape. The second platen 82 is assembled to the platen 80 to receive the first platen 81 such that side portions of the first platen 81 oppose those of the second platen 82. A shaft 93 extends through the fitting holes 91 and the elongated holes 84. A guide shaft 94 extends through the holes 92 an the guide holes 85. The shaft 93 is rotatably supported by a part of the printer, not shown. The shaft 93 fits into the fitting holes 91 and is fixedly assembled to the second platen 82 but is movable along the elongated holes 84. One end of a tension spring 96 is fastened to the underside of the second platen 82 and the other end is fastened to the main body of the printer. The spring 96 urges the second platen downward (FIG. 24).

The operation of the fifth embodiment will be described with reference to FIGS. 24 and 26.

Figure 26:
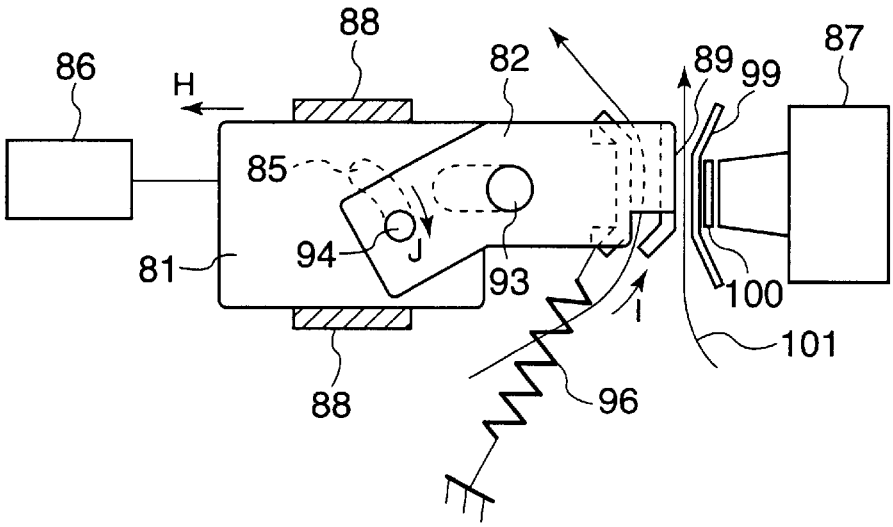
FIG. 26 is a side view of the platen according to the fifth embodiment.
Figure 27:
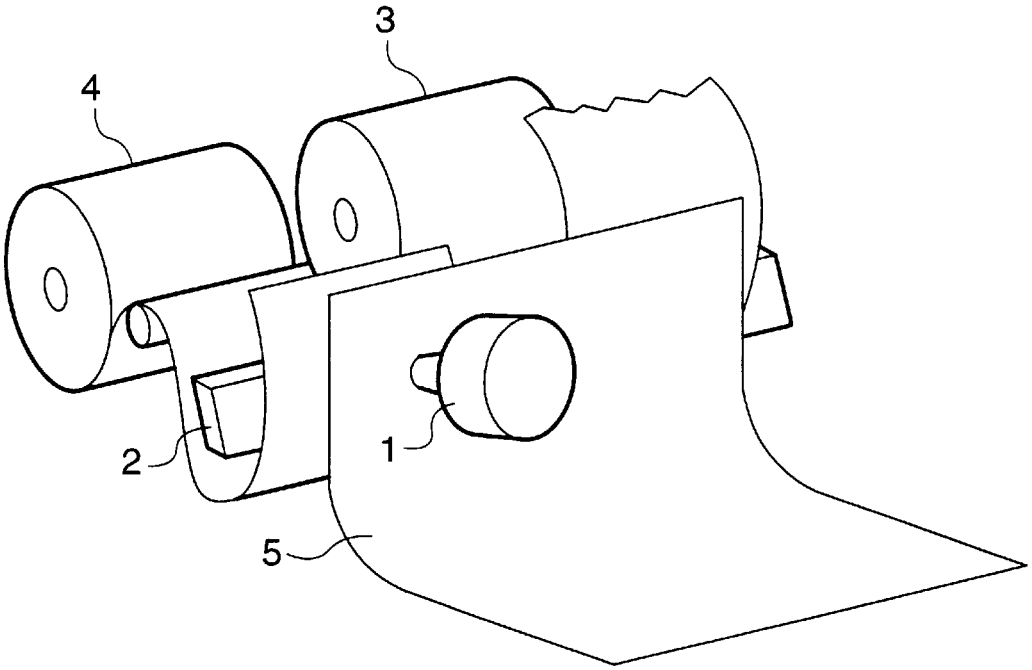
FIG.27 CONVENTIONAL ART
FIG. 27 illustrates a POS printer that prints on two different types of print paper.
Figure 28:
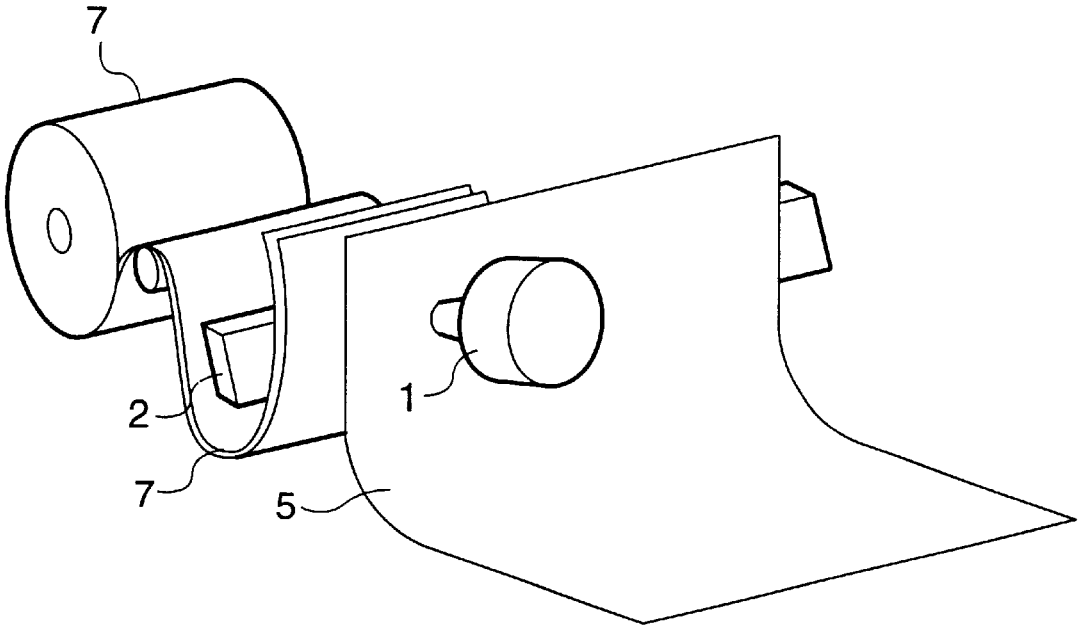
FIG.28 CONVENTIONAL ART
FIG. 28 illustrates the POS printer that prints on multi-part journal paper.
Figure 29:
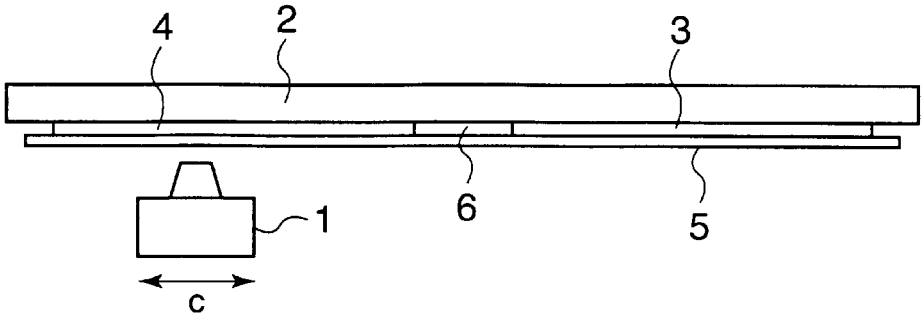
FIG.29 CONVENTIONAL ART
FIG. 29 illustrates a problem with the conventional platen.
Figure 30:
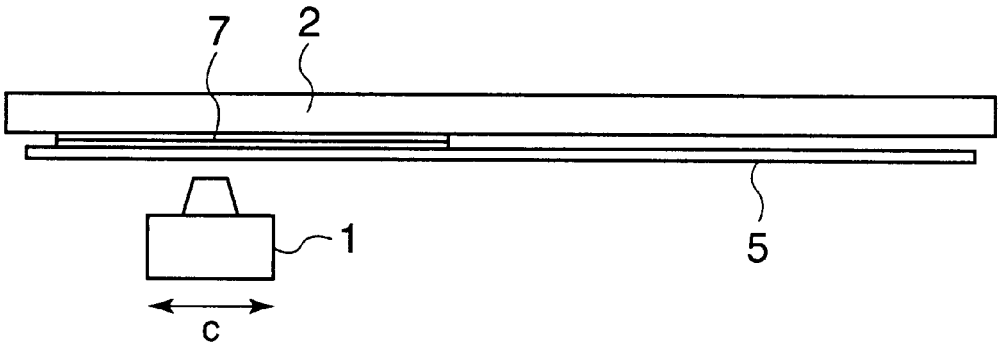
FIG.30 CONVENTIONAL ART
FIG. 30 illustrates a problem with the conventional platen.

FIG. 26 is a side view of the platen according to the fifth embodiment.

FIG. 24 illustrates a case in which the receipt paper or journal paper is printed.

Referring to FIG. 24, the impact surface 83 of the first platen 81 opposes the printhead 87. A ribbon protector 99 and an ink ribbon 100 are disposed between the impact surface 83 and the printhead 87. Paper 98 in roll form passes an inner side of the second platen 82 and then passes upward through a gap between the first platen 81 and the ribbon protector 99.

A printing operation is performed with the setup shown in FIG. 24. The solenoid 86 is off such that the tensile force of the spring 96 brings down the impact surface 89 of the second platen 82 and the first platen 81 moves closer to the printhead 87 to maintain a predetermined distance between the impact surface 83 and the printhead 87.

With the setup shown in FIG. 24, when printing is performed on a single sheet, a host apparatus causes the solenoid 86 to turn on. The first platen 81 is pulled leftward in FIG. 24, being guided by the slide guides 88 such that the second platen 82 rotates in a direction opposite to arrow E against the tensile force of the spring 96. The guide shaft 94 slides downward along the guide holes 85 and the second platen 82 rotates counterclockwise about the shaft 93, so that the impact surface 89 moves upward toward the printhead 87. The second platen 82 stops rotating when the impact surface 89 opposes the printhead 87.

Then, a single sheet 101 is loaded between the impact surface 89 and the ribbon protector 99. It is to be noted that the roll paper 98 is positioned behind the impact surface 89. Thus, the single sheet does not directly contact the roll paper 98. Thereafter, upon a command from the host apparatus, the printhead 87 prints on the signal sheet 101.

As described above, the fifth embodiment allows two platens to be selectively used depending on the types of print paper, thereby preventing the different types of print paper from contacting each other.

The first to fifth embodiments have been described with respect to a platen having two impact surfaces. More impact surfaces may of course be employed as required.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A platen having an impact surface wherein the impact surface comprises a first impact surface and a second impact surface positioned to oppose a printhead so that a part of a printhead strikes a print medium loaded on the impact surface, comprising:

a first path in which a first print medium passes between said first impact surface and said second impact surface and then between said first impact surface and the printhead; and a second path in which a second print medium passes between said second impact surface and the printhead.

2. The platen according to claim 1, wherein the platen is movable such that said first impact surface and said second impact surface are selectively positioned to oppose the printhead.

3. The platen according to claim 2, wherein the platen is rotatable about an axis and said first impact surface has a first curvature with respect to the axis and the second impact surface has a second curvature with respect to the axis.

4. The platen according to claim 1, wherein said first impact surface has a curved surface and said second impact surface has a curved surface.

5. The platen according to claim 4, wherein the platen is rotatable about an axis and said first impact surface has a first curvature with respect to the axis and the second impact surface has a second curvature with respect to the axis.

6. A printing apparatus having an impact surface wherein the impact surface comprises a plurality of impact surfaces positioned to oppose a printhead so that the printhead strikes a print medium against the impact surface, the apparatus comprising:

a plurality of printing paths;

the plurality of impact surfaces such that corresponding ones of a plurality of print media are supplied through the plurality of paths such that printing is performed on a corresponding one of the plurality of print media on a corresponding one of said plurality of impact surfaces; and drive means that drives said plurality of impact surfaces to move to selectively oppose the printhead so that print data is printed on one of the plurality of print media located between the printhead and a corresponding one of said plurality of impact surfaces.

7. The printing apparatus according to claim 6, wherein the plurality of print media are of different types and printing is performed on a corresponding one of the different types of print media that advances on a corresponding one of said plurality of impact surfaces.

8. The printing apparatus according to claim 6, wherein said drive means is controlled by a host apparatus so that the impact surfaces move to selectively oppose the printhead.

9. The printing apparatus according to claim 6, wherein said plurality of impact surfaces include an impact surface on which printing is performed on a single sheet;

wherein when the single sheet is loaded between the printhead and the impact surface, said drive means is controlled by a host apparatus so that the impact surface moves to oppose the printhead.

10. The printing apparatus according to claim 6, wherein said plurality of impact surfaces are formed on a platen having a cam lock that holds the platen in position.

11. A printing apparatus having an impact surface wherein the impact surface comprises a plurality of impact surfaces positioned to oppose a printhead so that the printhead strikes a print medium against the impact surface, the apparatus comprising:

the plurality of impact surfaces such that a plurality of types of print media are supplied through a plurality of paths such that printing is performed on a corresponding one of the plurality of types of print media on a corresponding one of said plurality of impact surfaces, said plurality of impact surfaces begins formed on a platen;

drive means that causes said plurality of impact surfaces to selectively oppose the printhead so that print data is printed on one of the plurality of types of print media located between the printhead and a corresponding one of said plurality of impact surfaces; and an opening through which one of the plurality of types of print media passes, the opening being formed in the platen between adjacent ones of said plurality of impact surfaces.

12. The printing apparatus according to claim 11, wherein the plurality of impact surfaces have curved surfaces with different curvatures.

13. The printing apparatus according to claim 11, wherein the plurality of impact surfaces are made of a harder material than the platen.

14. The printing apparatus according to claim 11, further comprising means that holds the platen in position when one of the plurality of impact surfaces opposes the printhead.

15. The printing apparatus according to claim 11, wherein one of said plurality of impact surfaces has a projection located near said opening.

16. A printing apparatus having an impact surface wherein the impact surface comprises a plurality of impact surfaces positioned to oppose a printhead so that the printhead strikes a print medium against the impact surface, the apparatus comprising:

the plurality of impact surfaces such that a plurality of types of print media are supplied through a plurality of paths such that printing is performed on a corresponding one of the plurality of types of print media on a corresponding one of said plurality of impact surfaces, each of said plurality of impact surfaces being formed on each of a plurality of platens, the plurality of platens being assembled such that there is a path between adjacent platens and a corresponding one of the plurality of types of print media passes through the path; and drive means that causes said plurality of impact surfaces to selectively oppose the printhead so that the print data is printed on one of the plurality of types of print media located between the printhead and a corresponding one of said plurality of impact surfaces.

17. The printing apparatus according to claim 16, wherein one of the plurality of impact surfaces is driven to selectively rotate about an axis to a first position where the at least one of the plurality of impact surfaces directly opposes the printhead and a second position where the at least one of the plurality of impact surfaces does not oppose the printhead;

wherein the plurality of impact surfaces are aligned with the printhead such that when the at least one of the plurality of impact surfaces rotates from the first position to the second position, said drive means causes an impact surface adjacent to the at least one of the plurality of impact surfaces to move closer to the printhead for printing.

* * * * *